US006241196B1

(12) United States Patent
Steurer et al.

(10) Patent No.: US 6,241,196 B1
(45) Date of Patent: Jun. 5, 2001

(54) CASING FOR A HOT BOX OR BLOCKED BRAKE DETECTION SCANNER

(75) Inventors: Erwin Steurer, Grosslobming; Wolfgang Nayer, Zeltweg, both of (AT)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 09/402,798

(22) PCT Filed: Mar. 13, 1998

(86) PCT No.: PCT/AT98/00067

§ 371 Date: Oct. 12, 1999

§ 102(e) Date: Oct. 12, 1999

(87) PCT Pub. No.: WO98/45153

PCT Pub. Date: Oct. 15, 1998

(30) Foreign Application Priority Data

Apr. 10, 1997 (AT) ..... 619/97

(51) Int. Cl.[7] ..... B61L 3/00
(52) U.S. Cl. ..... 246/169 A
(58) Field of Search ..... 246/169 A, 169 D, 246/169 R; 250/342, 332, 334, 349; 374/2; 340/463, 600, 584

(56) References Cited

U.S. PATENT DOCUMENTS

| | | | | |
|---|---|---|---|---|
| D. 314,919 | * | 2/1991 | Villar | D10/46 |
| 2,999,152 | * | 9/1961 | Gallagher et al. | 246/169 A |
| 3,435,223 | | 3/1969 | Haner et al. . | |
| 3,601,604 | | 8/1971 | Sibley . | |
| 3,790,777 | * | 2/1974 | Pelino | 246/169 A |
| 4,974,797 | | 12/1990 | Myers et al. . | |
| 5,100,243 | * | 3/1992 | Grosskopf et al. | 374/2 |
| 5,331,311 | * | 7/1994 | Doctor | 340/463 |

FOREIGN PATENT DOCUMENTS

| | | |
|---|---|---|
| 1918317 | 10/1969 | (DE) . |
| 911865 | 11/1962 | (GB) . |

* cited by examiner

*Primary Examiner*—Mark T. Le
(74) *Attorney, Agent, or Firm*—Pillsbury Winthrop LLP

(57) ABSTRACT

The invention relates to a casing for a hot box or blocked brake detection scanner (2) comprising infrared detectors and a heating means, wherein the casing is comprised of a casing lower part and a lid (5), the lid (5) is designed as a chimney top with lateral surfaces (7, 8) converging towards the upper edge and carrying an electrical heating means (4) on their inner sides (6), and the lid (5) includes openings (9) for the scanning geometry of the infrared detector(s) on its upper edge or near its upper edge.

20 Claims, 2 Drawing Sheets

CASING FOR A HOT BOX OR BLOCKED BRAKE DETECTION SCANNER

BACKGROUND OF THE INVENTION

1. Field of the Invention

The invention relates to a casing which includes a heating means for a hot box or blocked brake detection scanner comprising infrared detectors. The casing is attached to a track section.

2. Prior Art

Hot box or blocked brake detection scanners usually are mounted to rails with the measuring openings of the detectors being at a relatively slight distance relative to the rail upper edge. Such a slight distance in case of a snow or ice covering, as a rule, will not constitute a major problem if the layer of snow above the detector is melted by a heating means incorporated in the scanning means. Due to the slight distance, the upper edges of such detectors are cleaned by the relative wind produced by rolling rail vehicles. Known such devices have been described in DE-A-19 18 317, wherein a special supporting structure is screwed to the rail webs and the respective hot box or blocked brake detection means is mounted to the supporting structure.

DE-A-42 17 681 has already suggested the installation of hot box detection scanners or blocked brake detection scanners in a trough-shaped sleeper. The upper edge of such trough-shaped sleepers is located on the level of the rail foot and the hot box or blocked brake detection scanners are, therefore, immersed in the trough-shaped sleeper, from which results a relatively large distance between the upper edge of the rail and the measuring means. With such a large distance, larger amounts of snow or ice may build up above the detector, thus impairing or even preventing measurements.

SUMMARY OP THE INVENTION

The invention aims at providing a casing of the initially defined kind, which is suitable for being incorporated in a trough-shaped sleeper which safely utilizes the advantages of an installation directly in the trough-shaped sleeper even in adverse meteorological conditions and, in particular, when intensive snow fall or the like is likely to build up a thick layer of snow or ice on the detector. To solve this problem, the configuration according to the invention essentially consists in the casing being comprised of a casing lower part and a lid, the lid being designed as a chimney top with lateral surfaces converging towards the upper thereof and carrying an electrical heating means on their inner sides. The lid includes openings for the scanning beams of one or more infrared detectors on its upper edge or near its upper edge. By providing, in addition to a casing lower part which, in accordance with a preferred further development of the invention, is formed by the trough-shaped sleeper itself and a lid which is designed as a chimney top having lateral surfaces converging towards the upper edge, it is ensured that even in case of heavy snow fall, the snow will descend along the converging lateral surfaces under the action of gravity. By providing electrical heating means on the inner sides of the lateral surfaces and openings for the scanning beams of the infrared detector in the lid on its upper edge or near its upper edge, it is ensured that the integrated heating reliably keeps clear from snow or ice the respective opening cross section on the upper side of the lid by ascending hot air so as to allow the safe scanning and detection of hot boxes or blocked brakes. The surface available for a possible snow cover is relatively small, since that surface directly merges into the laterally sloping lateral surfaces converging towards the upper edge. By heating those lateral surfaces, at least a film of snow in direct contact with the lateral walls will melt such that the snow load can descend under its own weight and melt subsequently. Due to a stacking effect, the openings on the upper edge are safely kept clear even at a comparatively low heating performance, since, bearing in mind the small upper surface, the overall amount of snow or ice built up thereabove remains relatively small. This applies all the more, since the upper edge of the casing lid is brought near the travelling edges of the rail due to the chimney top such that even the relative wind of rolling rail vehicles will cause an additional mechanical cleaning effect. Advantageously, the configuration is devised such that the casing lower part comprises a further electrical heating means and is provided with discharge openings for melt water so as to prevent major amounts of snow from collecting in the interior of the upwardly open casing.

In a particularly simple manner, the heating means of the lid is designed as an electrical resistance heater having windings which extend substantially parallel with the bottom of the casing lower part. Such an arrangement of the electrical resistance heater directly results in the desired flow course of the ascending hot air, thus ensuring particularly efficient clearing of snow even at low heating performances.

In order to further, enhance mechanical cleaning by rolling rail vehicles, the track section with the casing attached thereto advantageously is devised such that the track section comprises a trough-shaped sleeper, that the casing is arranged in the trough-shaped sleeper, that the upper edge of the lid is arranged at a distance from the upper edge of the sleeper, which distance corresponds to the smallest admissible free space or clear space between the plane of the rail upper edge and the hot box detection scanner or blocked brake detection scanner. In order to ensure the correct orientation of the scanning beams and better take into account the geometrical conditions of hot box or blocked brake detection scanners installed in a trough-shaped sleeper, the configuration advantageously is devised such that the lid, in a cross-sectional plane through which the axis of the trough-shaped sleeper passes, is designed to be asymmetrically trapezoidal and that the upper surface, which is parallel to the plane of the rail travelling edges, is located in the projection on the trough-shaped sleepers of the bearings of a rolling rail is vehicle to be detected.

In a particularly simple manner, the casing lower part, as already mentioned, may be designed as a partial region of the trough-shaped sleeper and the lid may extend over the total width of the trough-shaped sleeper, viewed in the longitudinal direction of the rail, and be fixable thereto. In that case it will do to appropriately spot-drill, and provide with a thread, the end faces of the side walls of the trough-shaped sleeper such that the lid can be directly screwed and placed on the trough-shaped sleeper. Trough-shaped sleepers are usually provided with covers and the same means as are provided for fixing the covers of the trough-shaped sleeper may also be used for fastening the lid, including the chimney top In order to render the penetration or pressing in of snow or the like even more difficult, the configuration advantageously is devised such that the openings of the lid are equipped with closeable covers. The closeable covers may be formed by simple slides or flaps connected with an actuator, the opening of the covers being effected during the scanning procedure.

BRIEF DESCRIPTION OF THE DRAWINGS

In the following description, the invention will be explained in more detail by way of an exemplary embodiment schematically illustrated in the drawing. Therein.

DETAILED DESCRIPTION OF A PREFERRED EMBODIMENT OF THE INVENTION

Figure 1:
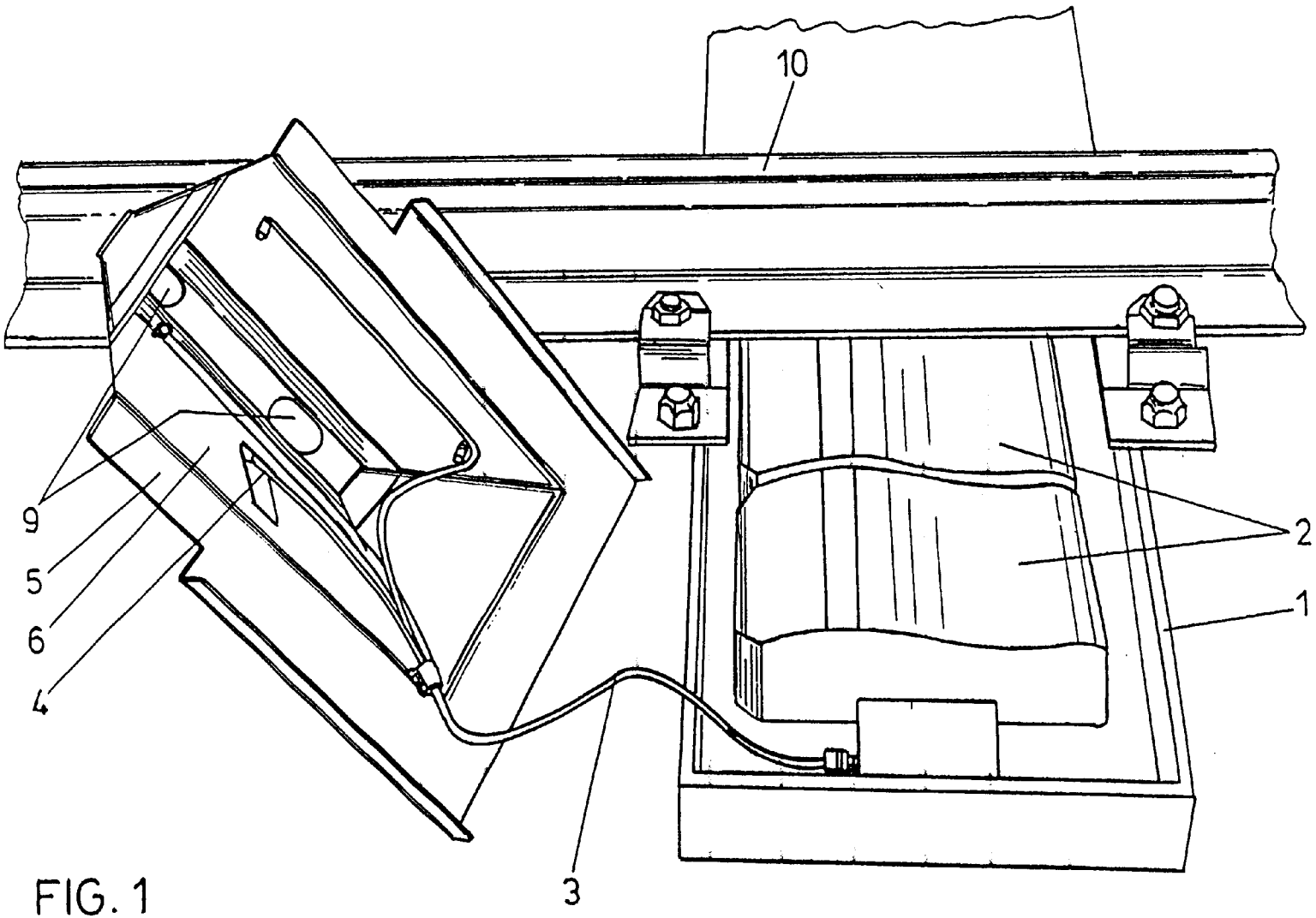
FIG. 1 is a perspective illustration of an opened trough-shaped sleeper with the lid being removed and hot box detection scanners being inserted.
Figure 2:
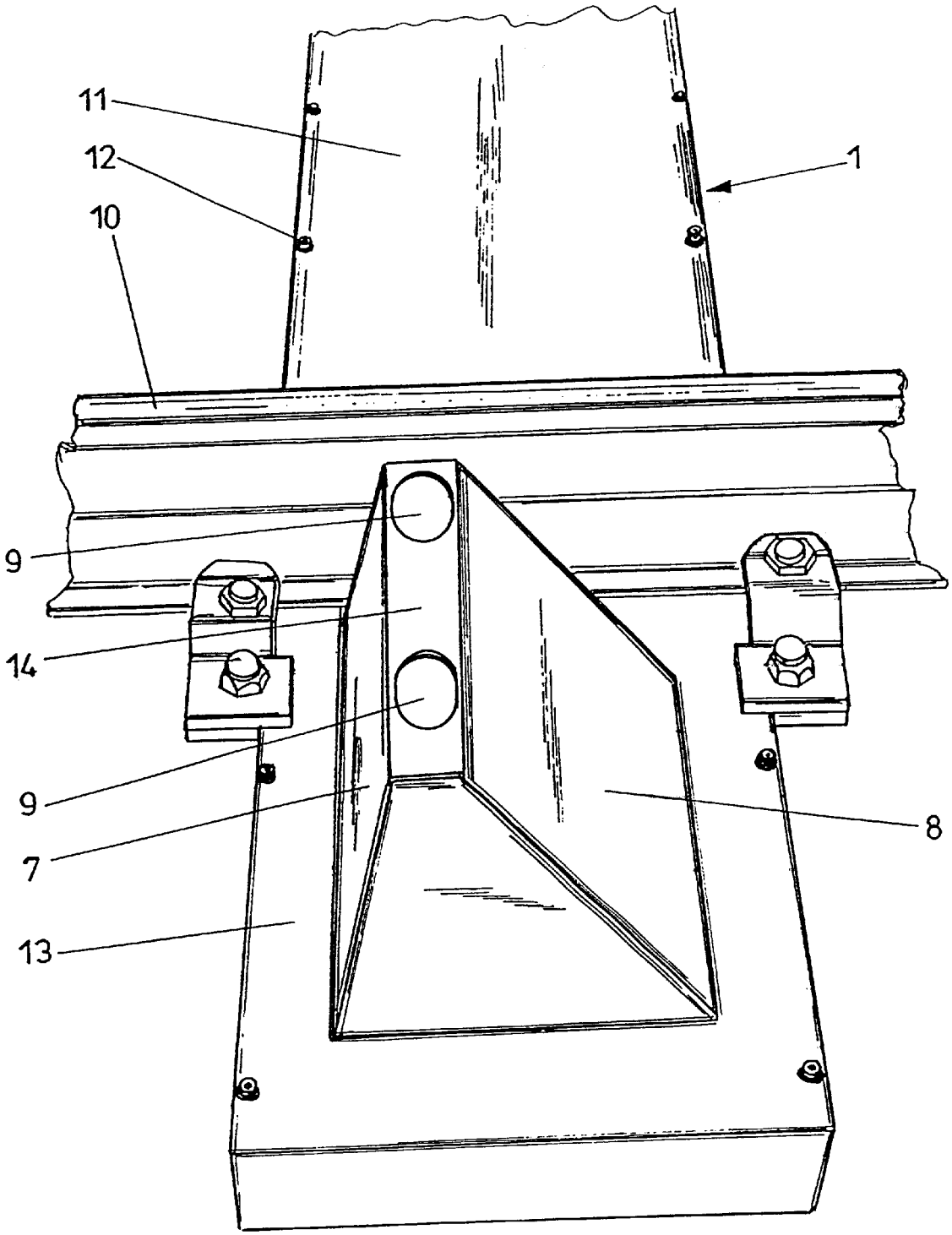
FIG. 2 shows the illustration according to FIG. 1 with the lid being closed.

From FIG. 1 a trough-shaped sleeper 1 is apparent, in which hot box detection scanners 2 are inserted. A heating means 4 is provided within the lid of the trough-shaped sleeper, a connecting cable 3 for the heating means 4 being visible in the lid 5. The heating means 4 provided in the lid is designed as a resistance heater which extends over the inner sides 6 of the lid side walls as denoted by 7 and 8 in FIG. 2. As is apparent, in particular, from FIG. 2, the upper edge of the lid includes openings 9 so that the required scanning geometry of the scanner on the bearings of a rolling rail vehicle can be ensured. In FIGS. 1 and 2, the rail is denoted by 10, wherein just one rail is depicted in each case. The trough-shaped sleeper 1 extends over the total width of the track. As is apparent from FIG. 2, the trough-shaped sleeper is closed by a plane lid 11 by means of screws 12. On the laterally protruding parts of the trough-shaped sleeper, in which the hot box detection means 2 is arranged, the lid 13 comprises two lateral surfaces 7 and 8 converging towards the upper edge, wherein the openings 9 are provided in a top surface 14 extending parallel to the upper edge of the rails 10. Due to the chimney-like top comprising mutually converging side walls 7 and 8, the area of the plane top surface 14 is extremely small and can be reliably cleared by the relative wind. The openings 9 are reliably kept clear of snow and ice by the heating means arranged on the internal walls 6 of the side walls 7 and 8 and by the stack effect caused by the same.

What is claimed is:

1. A casing for a hot box or a blocked brake detection scanner having at least one infrared detector and an electrical heating means, wherein the casing comprises a base portion covered by a lid having inclined lateral surfaces converging towards an upper edge and carrying said heating means on inner sides of said surfaces, and wherein the lid includes at least one opening for accommodating a scanning geometry of the infrared detector on at least one of said upper edge and an inclined surface adjacent said upper edge.

2. A casing according to claim 1, wherein the base portion is capable of carrying a further electrical heating means.

3. A casing according to claim 1 or 2, wherein the heating means within the lid is an electrical resistance heater extending substantially parallel with the base portion.

4. A casing according to claim 1 or 2, wherein the upper edge of the lid, when said base portion of the casing is located on a sleeper which underlies a rail, is disposed at a distance from an upper edge of the sleeper which minimizes a space between the plane of a rail upper edge and the detection scanner.

5. A casing according to claim 4, wherein the lid, when viewed in a plane normal to the longitudinal axis of the trough-shaped sleeper, is asymmetrically trapezoidal, and an upper surface of the lid is parallel to a plane of an upper edge of the rail and is located below bearings of a rolling rail vehicle traveling on said rail.

6. A casing according to claim 4, wherein the casing base portion is formed from a region of a trough-shaped sleeper, and the lid extends over a total width of the sleeper, as viewed in a longitudinal direction of the rail, and is fixed to the base portion.

7. A casing according to claim 1 or 2, wherein the opening of the lid is configured to be covered by a closable cover.

8. A casing according to claim 3, wherein the upper edge of the lid, when said base portion of the casing is located on a sleeper which underlies a rail, is disposed at a distance from an upper edge of the sleeper which minimizes a space between the plane of a rail upper edge and the detection scanner.

9. A casing according to claim 8, wherein the lid, when viewed in a plane normal to the longitudinal axis of a trough-shaped sleeper, is asymmetrically trapezoidal, and an upper surface of the lid is parallel to a plane of an upper edge of the rail and is located below bearings of a rolling rail vehicle traveling on said rail.

10. A casing according to claim 8, wherein the casing base portion is formed from a region of a trough-shaped sleeper, the lid extends over the total width of the sleeper, as viewed in a longitudinal, direction of the rail, and the lid is fixed to the casing base portion.

11. A casing according to claim 9, wherein the casing base portion is formed from a region of a trough-shaped sleeper, and the lid extends over a total width of the sleeper, as viewed in a longitudinal direction of the rail, and is fixed to the base portion.

12. A casing according to claim 3, wherein the opening of the lid is configured to be covered with a closable cover.

13. A casing according to claim 4, wherein the opening of the lid is configured to be covered with a closable cover.

14. A casing according to claim 5, wherein the opening of the lid is configured to be covered with a closable cover.

15. A casing according to claim 6, wherein the opening of the lid is configured to be covered with a closable cover.

16. A casing according to claim 7, wherein the opening of the lid is configured to be covered with a closable cover.

17. A casing according to claim 8, wherein the opening of the lid is configured to be covered with a closable cover.

18. A casing according to claim 9, wherein the opening of the lid is configred to be covered with a closable cover.

19. A casing according to claim 10, wherein the opening of the lid is configured to be covered with a closable cover.

20. A casing according to claim 11, wherein the opening of the lid is configured to be covered with a closable cover.

* * * * *